US005936995A

United States Patent [19]

Sullivan et al.

[11] Patent Number: 5,936,995

[45] Date of Patent: Aug. 10, 1999

[54] ELECTRIC ARC FURNACE WITH SCRAP DIVERTING PANEL AND ASSOCIATED METHODS

[75] Inventors: Terry J. Sullivan; Manfred Haissig, both of Concord, N.C.

[73] Assignee: Fuchs Systems, Inc., Salisbury, N.C.

[21] Appl. No.: 08/969,853

[22] Filed: Nov. 14, 1997

[51] Int. Cl.[6] ..... F27D 1/02

[52] U.S. Cl. ..... 373/74; 373/71

[58] Field of Search ..... 373/71, 74, 2, 373/76, 72, 84, 82; 266/159; 432/77; 122/6 A; 110/180

[56] References Cited

U.S. PATENT DOCUMENTS

| | | | |
|---|---|---|---|
| 3,952,140 | 4/1976 | Wunsche | 373/76 |
| 4,077,614 | 3/1978 | Udo et al. | 266/159 |
| 4,207,060 | 6/1980 | Zangs | 432/77 |
| 4,435,814 | 3/1984 | Bjihler | 373/76 |
| 4,458,351 | 7/1984 | Richards | 373/76 |
| 4,563,766 | 1/1986 | Bick et al. . | |
| 4,570,550 | 2/1986 | Wilt | 110/180 |
| 4,730,336 | 3/1988 | Herneisen et al. | 373/2 |
| 4,805,186 | 2/1989 | Janiak et al. . | |
| 4,853,941 | 8/1989 | Rappinger et al. | 373/72 |
| 4,903,640 | 2/1990 | Howard | 122/6 A |
| 5,117,438 | 5/1992 | Ehle et al. . | |
| 5,227,119 | 7/1993 | Zalner et al. | 373/74 |
| 5,238,484 | 8/1993 | Pirklbauer et al. . | |
| 5,410,566 | 4/1995 | Steins et al. | 373/82 |

*Primary Examiner*—Teresa Walberg
*Assistant Examiner*—Quang Van
*Attorney, Agent, or Firm*—Allen, Dyer, Doppelt, Milbrath & Gilchrist, P.A.

[57] ABSTRACT

An electric arc furnace includes a melting vessel having a top opening and an inside wall surface. A removable roof is positioned over the top opening and can be removed for permitting the charging of scrap into the melting vessel. An electrode extends through the roof into the melting vessel. A slag door portion defines a slag discharge opening discharged from the melting furnace. An arcuate configured water-cooled panel includes opposing upper and lower ends and opposing side ends. This water-cooled panel is mounted in the melting vessel above the slag door portion so that the lower end is angled inwardly away from an adjacent inside surface of the melting vessel. The side ends curve toward the adjacent inside surface of the melting vessel to minimize any arcing between the opposing side ends and the electrodes, and to avoid damage from scrap charging. The water-cooled panel forms a scrap free area adjacent to slag door portion.

49 Claims, 6 Drawing Sheets

ELECTRIC ARC FURNACE WITH SCRAP DIVERTING PANEL AND ASSOCIATED METHODS

FIELD OF THE INVENTION

This invention relates to electric arc furnaces, and more particularly, to electric arc furnaces having a slag discharge opening in the side of the furnace.

BACKGROUND OF THE INVENTION

With the general decline in heavy steel manufacturing using large open hearth and basic oxygen furnaces, many minimills and small steel plants that use electric arc furnaces have become more common. These smaller plants and minimills must maintain high efficiency to maintain their competitive edge against the larger, more integrated steel manufacturers.

An electric arc furnace typically includes a melting vessel comprising an upper shell portion, which is defined by a plurality of water-cooled panels, and a lower shell portion that is lined with refractory brick. A removable roof covers the vessel and at least one electrode extends through the roof. The furnace also typically includes a slag door portion defining a slag discharge opening covered by a slag door mounted on the melting vessel. A slag pit or slag pot is positioned underneath the slag discharge opening outside the furnace to collect the poured off slag. The slag discharge opening is important because an operator not only can view the furnace through this opening, but an oxygen lance may also be extended into the melting vessel through the slag discharge opening. This oxygen lance is important for providing the necessary oxygen for combustion. Thus, it is important to maintain this slag door portion clear of scrap.

During charge or loading of an electric arc furnace with scrap metal dumped from an overhead scrap bucket, the scrap falls into the upper shell and lower shell and typically distributes along certain angles, such as 25–45 degrees. Because of this angle, the scrap typically fills the slag door portion of the furnace. This may cause yield losses because as the scrap door is opened, some of the scrap accumulated at this slag door portion falls in the slag pot adjacent to the door. During furnace operation, the scrap accumulated in the area adjacent to the slag door portion causes the scrap discharge opening to become smaller, thereby blocking an operator's view into the furnace and impeding the introduction of an oxygen lance through the slag discharge opening.

Some prior art electric furnaces have been designed to minimize any interference with the entry of the oxygen lance into the slag discharge opening and maintain an operator's view of the melt. For example, in U.S. Pat. No. 4,563,766 to Bick et al., the charging volume of an electric arc furnace is increased with an increased diameter of the melting vessel, without essentially changing the usually provided height of the furnace container with the dimension of the hearth.

In U.S. Pat. No. 4,805,186 to Janiak, et al., the electrodes are offset towards an orifice in which scrap is fed to locate the hottest point forming the melting center of the scrap in the same place where the scrap can be introduced continuously. Thus, the scrap will melt faster and possibly reduce the chance of blockage.

In one prior art technique used by the assignee of the present invention, a scrap diverting panel in the form of a rectangular configured water-cooled panel was positioned above the slag door portion and extended inwardly at a lower portion to form a scrap free area adjacent the slag door portion. This water-cooled panel formed an awning above the slag door portion, in effect, creating a scrap free area, which could receive the oxygen lance a greater distance into the melting vessel. Before the use of this panel, the oxygen lance could not extend very far into the melting vessel because the scrap impeded the oxygen lance through the slag discharge opening. With the panel, the oxygen lance could be inserted into the scrap free area. However, this rectangular configured panel had corners that extended outward away from the inside surface of the melting vessel. These exposed corners increased the chance that a potentially damaging arc would be generated between the electrode and the exposed corners. This electrode arcing between the electrode and corners (as shown in FIG. 1) reduced furnace efficiency, increased energy costs, and reduced electrode life. In addition, the exposed corners of the panel were subject to damage during scrap charging.

SUMMARY OF THE INVENTION

In view of the foregoing background, it is therefore an object of the present invention to provide an electric arc furnace that forms a scrap free area adjacent to the slag door portion, while reducing the likelihood of any arcing between the electrode and a scrap diverting panel mounted on the sidewall of the melting vessel adjacent to the slag door portion.

It is still another object of the present invention to provide an electric arc furnace having a scrap free area formed adjacent to the slag door portion to allow an oxygen lance to be extended a greater distance through the slag discharge opening and into the melting vessel.

These and other objects, features and advantages of the present invention are provided by an electric arc furnace that includes a melting vessel, including a top opening. A removable roof is positioned over the top opening and can be removed for permitting charging of scrap into the melting vessel. A slag door portion defines a slag discharge opening through which slag can be discharged from the melting furnace.

In accordance with one aspect of the invention, scrap diverting means is positioned on the inside surface of the melting vessel above the slag door portion for diverting scrap charged into the melting vessel away from the slag door portion. The scrap diverting means preferably further comprises arc minimizing means to minimize any arcing between the electrode and scrap diverting means. In one aspect of the present invention, the scrap diverting means further comprises an arcuate configured water-cooled panel mounted in the melting vessel above the slag door portion.

The water-cooled panel includes opposing upper and lower ends and opposing side ends and is positioned so that the lower end is angled inwardly away from the adjacent inside surface of the melting vessel. The side ends are curved toward the inside surface of the melting vessel to minimize any arcing between the opposing side ends and the electrode and form a scrap free area adjacent to the slag door portion. The arcuate configured water-cooled panel also has a radius of curvature that progressively increases from the upper end to the lower end to position the lower end inwardly of the adjacent inside surface of the melting vessel.

In still another aspect of the present invention, the water-cooled panel comprises a serpentine configured cooling pipe and includes at least one inlet and outlet formed in the cooling pipe through which cooling fluid flows to and from the cooling pipe. The serpentine configured cooling pipe also can include a double inlet and double outlet forming two cooling circuits, which aids in balancing water flow with other water-cooled panels positioned along the inside surface of the melting vessel.

Typically, the serpentine configured cooling pipe further comprises a plurality of cooling pipe sections that extend horizontally from opposing side ends. The distance between opposing side ends of the water-cooled panel is greater than the distance between opposing upper and lower ends.

In still another aspect of the present invention, the arcuate configured water-cooled panel further comprises an arcuate configured and vertically extending base plate fixed to the inside surface of melting vessel and connected to the water-cooled panel for supporting the water-cooled panel in its position above the slag door portion. The melting furnace also can include a plurality of water-cooled panels positioned along the inside surface of the melting vessel. An oxygen lance is positioned adjacent to the slag door portion. The oxygen lance is moved through the slag discharge opening defined in the slag door portion and into the scrap free area adjacent to the slag door portion.

The scrap door portion typically includes a scrap door for covering the slag discharge opening and slag collection means for collecting slag poured from the slag discharge opening. The slag collection means can comprise a slag pit. Besides an oxygen lance, a burner can also be positioned in the slag door portion to aid in preheating the scrap, thus reducing the amount of time it takes to melt the scrap and form a liquid melt.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
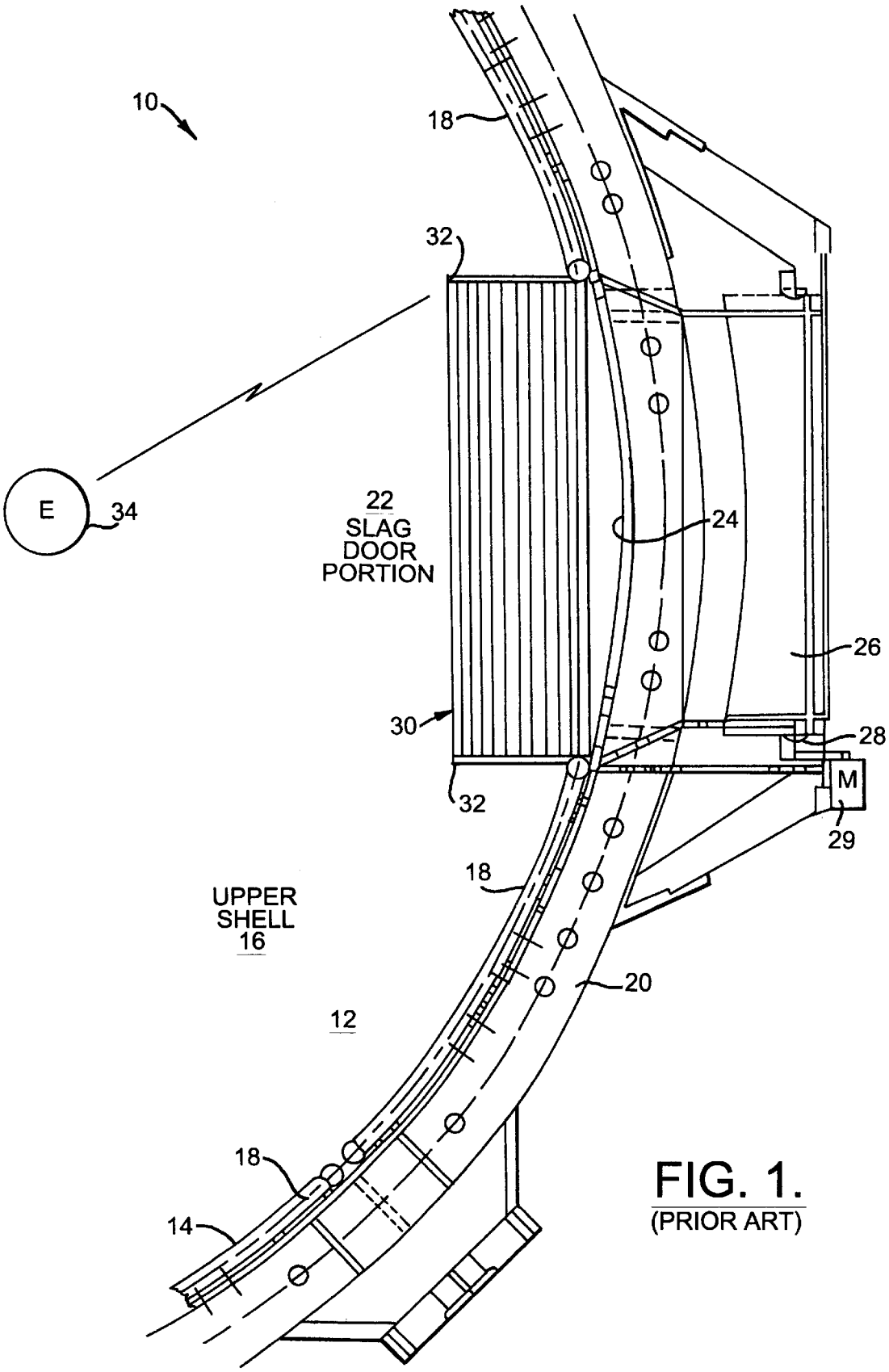
FIG. 1. (PRIOR ART)
FIG. 1 is a plan view of a portion of the upper shell of the melting vessel with the roof removed, and showing a prior art rectangular configured, water-cooled panel positioned above the slag door portion and an arc generated from the electrode to an exposed corner of this prior art panel.

The present invention will now be described more fully with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements throughout.

The electric arc furnace of the present invention is advantageous over the prior art electric arc furnace shown in FIG. 1 because the chance of generating an electric arc from the electrode to the scrap diverting panel forming the scrap free area is reduced. In the present invention, a scrap free area is formed adjacent to the slag door portion by an arcuate configured water-cooled panel, which is mounted in the melting vessel above the slag door portion. This water-cooled panel is configured to reduce any arcing between the water-cooled panel and the electrode. Thus, energy costs are reduced, and electrode life is increased, reducing the overall cost of operation. In addition, there are no exposed corners to be mechanically damaged by scrap being charged.

FIG. 1 illustrates a portion of a prior art electric arc furnace, illustrated generally at 10, which includes a melting vessel 12. An inside wall surface 14 is defined by cooling panels. Typically, the electric arc furnace 10 is cylindrically or oval configured, and can range in diameter from 15 feet to 45 feet or more, depending on the type and quantity of the desired melt. In the portion illustrated in FIG. 1, a portion of the upper shell 16 is illustrated. A plurality of water-cooled panels are mounted to define the inside wall surface 14 of the upper shell 16, and form the cooling panels necessary for steelmaking. In some electric arc furnaces, a refractory material can be substituted for the water-cooled panels, but this is not the norm. A lower shell (not shown) is positioned below the upper shell 16, and usually includes a refractory material, such as brick, lining the inside wall surface of the lower shell. The electric arc furnace has a top flange 20.

As illustrated, a slag door portion 22 is formed in the melting vessel 12 typically below the area formed by the upper shell 16 and water-cooled panels 18, and defines a slag discharge opening 24 through which slag can be discharged from the melting vessel 12 during a melt. A slag door 26 is positioned over the slag discharge opening 24 and is removable for exposing the slag discharge opening 24 and allowing an operator to view the melt during furnace operation, and position an oxygen lance (not shown) through the slag discharge opening 24 into the melting vessel 12. The slag door 26 can be moved to expose the slag discharge opening 24 by a conventional means known to those skilled in the art, such as an illustrated sliding mechanism 28 or other means.

As illustrated, the prior art rectangular configured water-cooled panel 30 is positioned above the slag door portion 22 and includes corners 32 that extend inwardly away from the inside wall 14 surface of the melting vessel 12. These exposed corners 32 tend to attract an arc from the electrode 34 as illustrated. Naturally, any generated electric arc between the electrode 34 and the exposed corners reduces electrode life and increases the total energy costs. Additionally, yield efficiency of the electric arc furnace is reduced. Also, the exposed corners could be damaged during scrap charging. The present invention reduces the tendency for an arc to generate from the electrode to any scrap diverting means, such as the illustrated prior art rectangular configured, water-cooled panel 30 positioned above the slag door portion. For clarity, the same reference numerals are used through this description when referring to similar elements.

Figure 2:
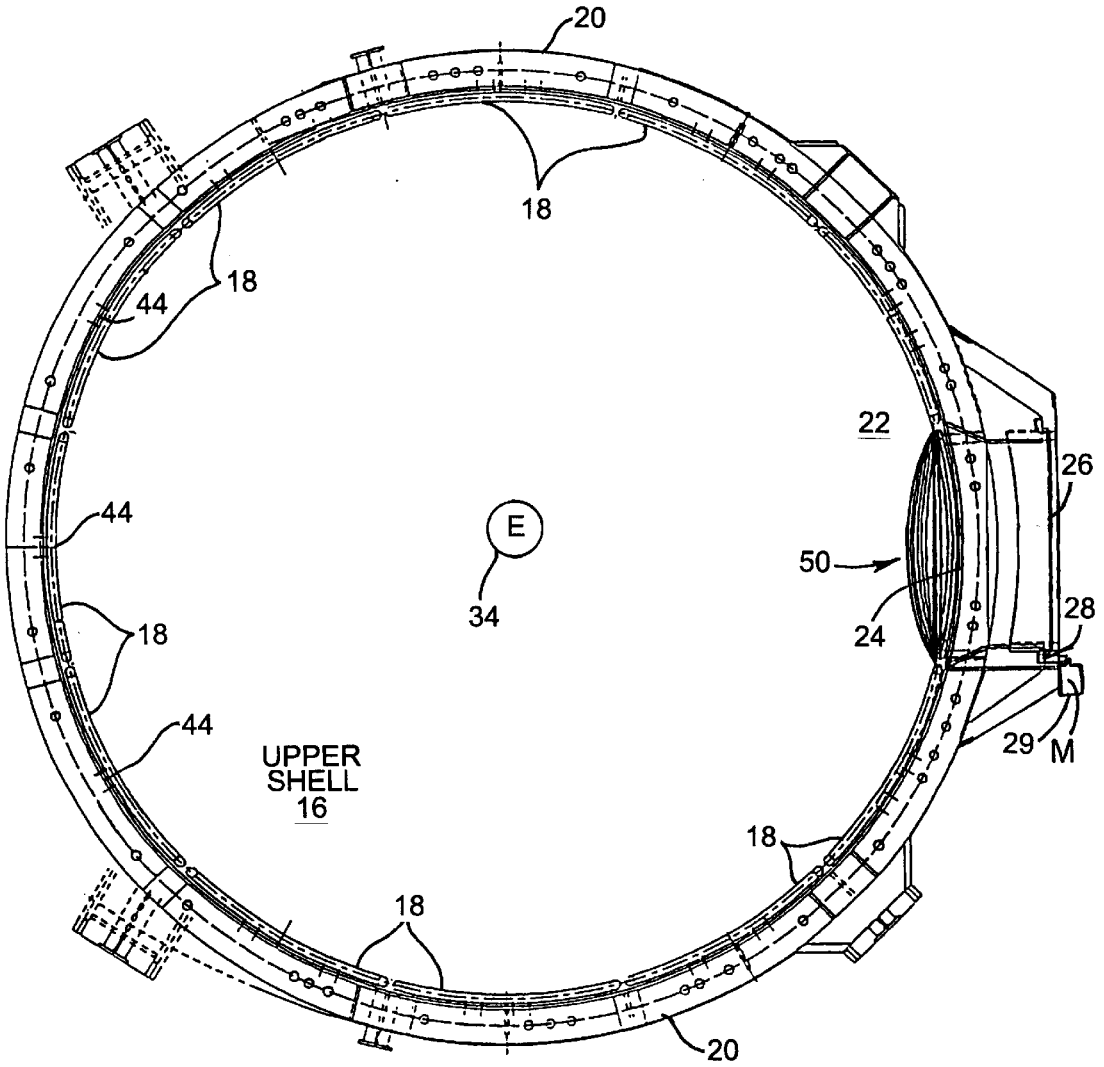
FIG. 2 is a plan view of the upper shell of the melting vessel showing the arcuate configured water-cooled panel of the present invention mounted above the slag door portion.
Figure 3:
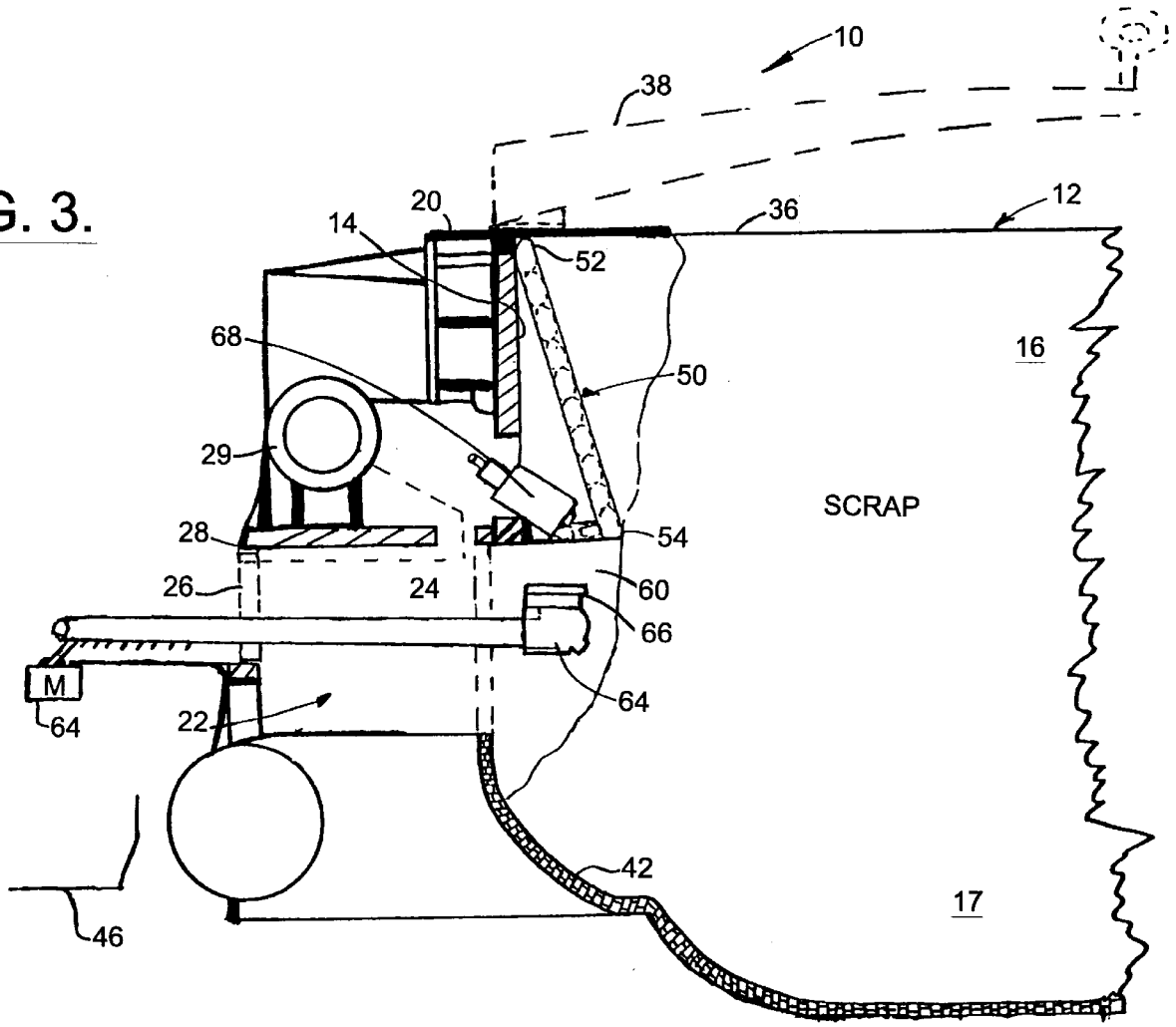
FIG. 3 is a schematic side sectional view of a portion of the electric arc furnace, showing a portion of the melting vessel and slag door portion, and the arcuate configured water-cooled panel positioned above the slag door portion, and an oxygen lance positioned within the scrap free area.

Referring now to FIGS. 2 and 3, there is illustrated the electric arc furnace 10 of the present invention. As illustrated, the electric arc furnace 10 includes an upper shell 16 and a lower shell 17. The upper shell 16 includes a top opening 36. A removable roof 38 is positioned over the top opening 36.

One or more electrodes 34 extend into and through the roof. The roof 38 is removed and permits the charging of scrap into the melting vessel 12. The electric arc furnace 10 is typically about 15 to 40 feet in diameter, but varies depending on the design. The lower shell 17 is positioned below the upper shell and includes a refractory lining 42, typically formed from brick or other refractory material. The upper shell 16 has a plurality of water-cooled panels 18 that define the inside wall surface 14 of the melting vessel 12. As noted before, the upper shell 16 can include a refractory material instead of the water-cooled panels.

As is well known to those skilled in the art, burners 44 are positioned at predetermined locations around the inside wall surface and provide the preheating to aid in melting the scrap. The water-cooled panels defining the inside wall surface 14 of the upper shell 16 provide the cooling means necessary for electric arc furnace operation. Water-cooled panels (not shown) can also be positioned on the removable roof 38 of the electric arc furnace as is well known to those skilled in the art.

A slag door portion 22 is positioned at the side of the melting vessel 12 and defines a slag discharge opening 24 through which slag can be discharged from the melting vessel 12 during a melt. As shown in FIGS. 2 and 3, the movable slag door 26 covers the slag discharge opening 24 formed in the slag door portion. A slag pit 46 is positioned outside the melting vessel 12 under the slag discharge opening 24 and collects the slag discharged through the slag discharge opening 24 during the melt. The slag door 26 can be mounted on a sliding mechanism 28 or appropriate means and moved by an appropriate motor mechanism 29 or other suitable means, even by manual operation.

As shown in FIGS. 2 and 3, an arcuate configured water-cooled panel, in accordance with the present invention, and illustrated generally at 50, is positioned above the slag door portion 22 and includes opposing respective upper and lower ends 52, 54 and opposing side ends 56, 58 (FIG. 4), and is positioned above the slag door portion 22 so that the lower end 54 is angled inwardly away from an adjacent inside wall surface 14 of the melting vessel 12. The side ends 56, 58 are curved toward the adjacent inside wall surface 14 of the melting vessel 12 to minimize any arcing between the opposing side ends 56, 58 and the electrode 34 extending through the removable roof 38. The unexposed side ends 56, 58 also reduce the likelihood of physical damage to the water-cooled panel.

In the electric arc furnace 10 shown in FIG. 1, the prior art rectangular configured water-cooled panel 18 extends outwardly into the melting vessel toward the electrode 34 and forms a structure having exposed corners 32 that attract an arc from the electrode. This arcing naturally reduces electrode life and increases the costs associated with operating the electric arc furnace 10. The present invention overcomes the deficiencies in this prior art construction by forming the scrap diverting, water-cooled panel as an arcuate configured panel having side ends 56, 58 that curve toward the adjacent inside wall surface 14 of the melting vessel 12 as shown in FIGS. 2 and 4.

Figure 6:
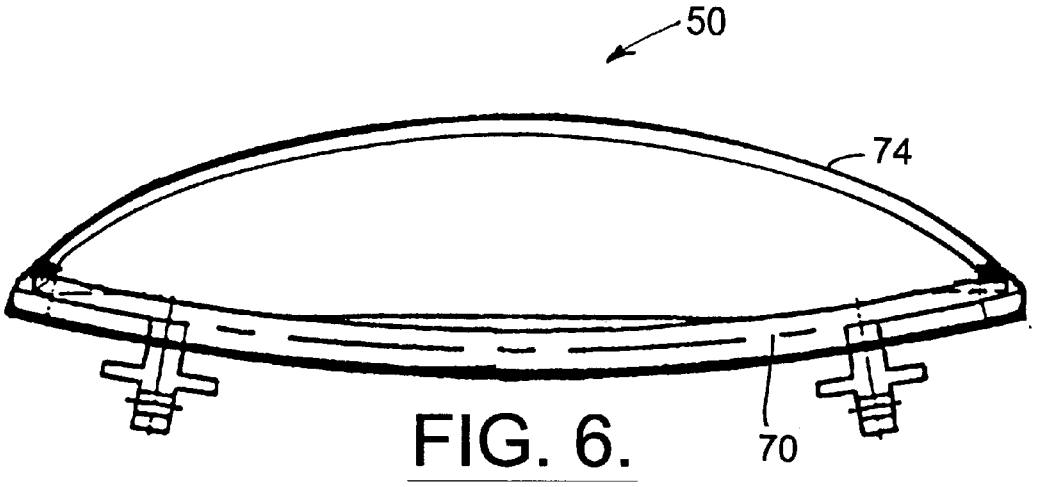
FIGS. 6–8 are sectional views taken along lines 6—6, 7—7 and 8—8 of the arcuate configured, water-cooled panel of FIG. 5, showing the radius of curvature progressively increasing from the upper end to the lower end.
Figure 7:
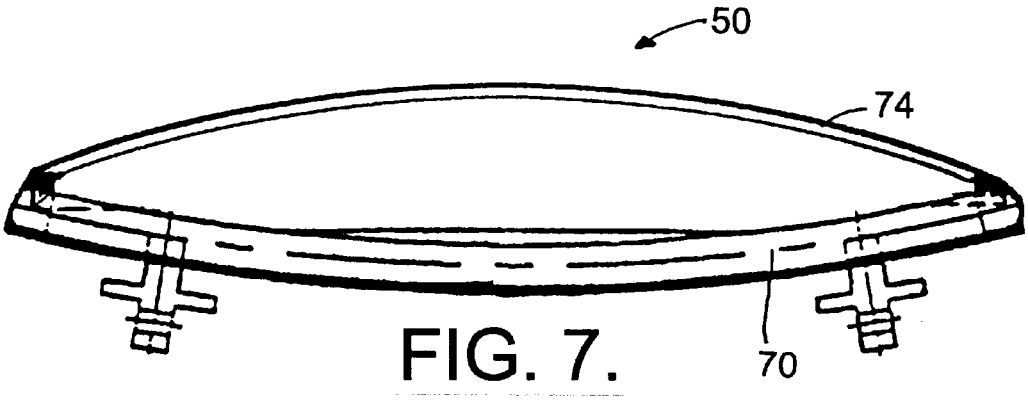
Figure 8:
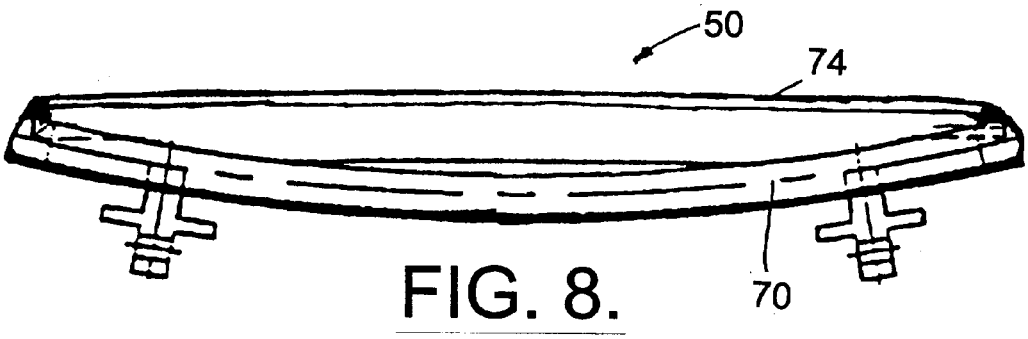

As shown in the sectional views of the arcuate configured water-cooled panel 50 in FIGS. 6–8, the panel 50 has a radius of curvature that progressively increases from the upper end 52 to the lower end 54 which is positioned inwardly of the adjacent inside wall surface 14 of the melting vessel 12 . FIG. 6 illustrates the curve of the water-cooled panel 50 at its lower end 54 where it is positioned a greater distance inwardly of the adjacent inside wall surface 14 of the melting vessel 12. FIG. 7 shows the intermediate section midway between upper and lower ends 52, 54, where the curve of the water-cooled panel 50 is less than at its lower end 54. FIG. 8 shows the section view where the water-cooled panel 50 is positioned its closest distance to the adjacent inside wall surface 14 of the melting vessel 12. Thus, as shown in FIG. 2, the arcuate configured water-cooled panel 50 forms an "awning" structure that has no exposed corners as compared to the prior art structure illustrated in FIG. 1. The tendency for arcing between the electrode and the water-cooled panel 50 is thus minimized.

The area immediately underneath the arcuate configured water-cooled panel 50 adjacent to the slag door portion 22 forms the scrap free area 60 in the location of the electric arc furnace known also by those skilled in the art as the "breast". As illustrated, the "awning" effect of the panel 50 maintains this area inside the furnace adjacent to the slag door portion 22 and within the slag discharge opening 24 free of slag. The slag free area 60 formed under the panel 50 also allows an oxygen lance 62 to be positioned a greater distance into the melting vessel 12. The oxygen lance 62 can be positioned on a drive assembly 64, which allows the oxygen lance to be moved during a heat through the slag discharge opening 24, into the "breast" of the furnace, without engaging slag. Because slag no longer fills the breast and slag door portion 22, a burner 66 can be positioned at the end of the oxygen lance 62, and aids scrap heating. A burner 68 can also be positioned in the area behind the water-cooled panel 50 to provide a preheating flame on the scrap to aid in melting the scrap.

Figure 4:
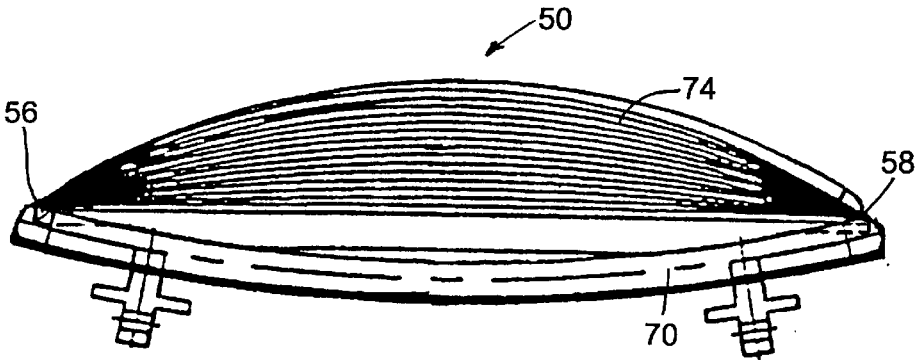
FIG. 4 is a top plan view of the arcuate configured water-cooled panel of the present invention.
Figure 5:
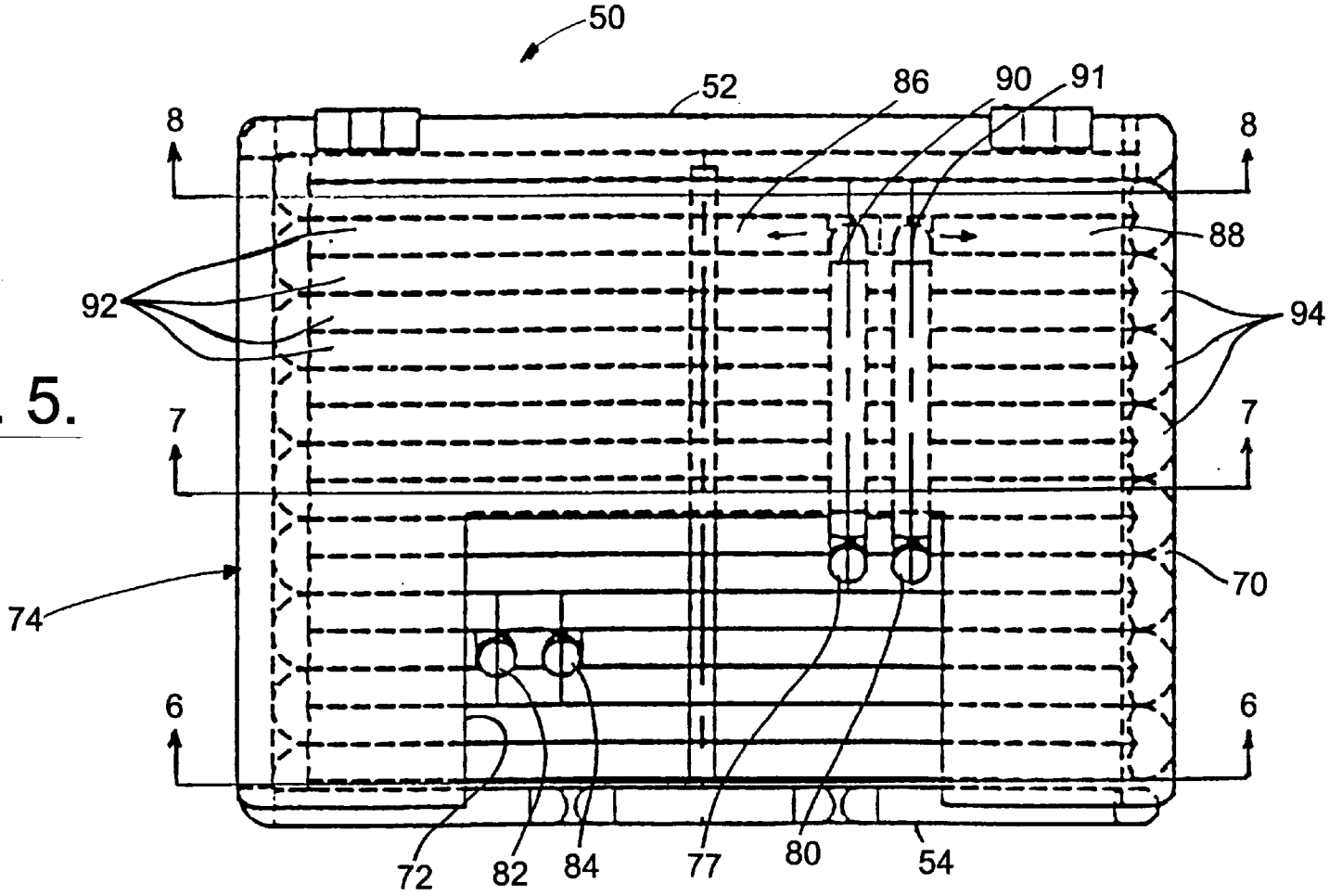
FIG. 5 is a rear elevation view of the water-cooled panel of the present invention.

Referring now to FIGS. 4 and 5, greater details of the arcuate configured water-cooled panel 50 are illustrated. An arcuate configured and vertically extending base plate 70 is connected to the water-cooled panel 18 for supporting the water-cooled panel 50 along its opposing side ends 56, 58 and the upper end 52 (FIG. 3). The base plate 70 has a curvature that defines the circular outline of the furnace. The base plate 70 provides rigidity and stability to the water-cooled panel 50. A rectangular opening 72 can be formed in the base plate 70 to allow the burner 68 to extend into the scrap free area 60 behind the water-cooled panel 50 and provide heating to the scrap. The burner 68 would heat the scrap by ejecting burning heated gas at an angle into the scrap adjacent to the scrap free area.

As shown in FIG. 5, the water-cooled panel 50 also comprises a serpentine configured cooling pipe 74 (shown by the dotted lines), and includes at least one inlet and outlet formed in the cooling pipe to which cooling fluid, such as water, flows to and from the cooling pipe. In the illustrated embodiment shown in FIG. 5, the serpentine configured cooling pipe 74 includes two inlets 78, 80 and two outlets 82, 84 forming two cooling circuits indicated generally at 86 and 88. In the left inlet 78 shown in FIG. 5, the water would extend upward through an inlet pipe 90 and then flow left as shown by the arrow. The water flows downward to the left most outlet 82. Water entering the inlet 80 at the right would flow upward through the inlet pipe 91 and flow through the second circuit 88 and out the second outlet 84.

The two inlets 78, 80 and two outlets 82, 84 form two piping circuits 86, 88 that help achieve a water flow balance with the other water-cooled panels 18 positioned in the upper shell (FIG. 2). The water flow is critical through all cooling panels, and can be provided by one large source. Thus, water flow should not be impeded. Not only does the arcuate curvature of the water-cooled panel 50 help water flow, but also the two circuits 86, 88 help reduce resistance to water flow. The two piping circuits 86, 88 can be formed back-to-back.

As illustrated, the cooling pipe 74 further comprises a plurality of cooling pipe sections 92 that extend horizontally from opposing side ends 56, 58. The distance between opposing side ends is greater than the distance between opposing upper and lower ends to form a more streamlined design having a reduced number of elbow joint sections 94 at the side ends 56, 58, which also reduces the pressure drop associated with the water-cooled panel 50.

In the larger capacity electric arc furnaces, a water flow rate of 150 1/min.$m^2$ (3.65 gpm/$ft^2$) for a side wall water-cooled panel or 170 1/min.$m^2$ (4.14 gpm/$ft^2$) for a roof water-cooled panel should be available. For DC furnaces, an even greater water flow rate through the cooling pipe 74 should be available, typically, at least a 10–20 l/min.$m^2$ (0.25–0.5 gpm/$ft^2$) more depending on arc power and arc voltage. If too much scrap is placed in the furnace so that the distance between the scrap and roof is short, additional water is required.

If enough water is available for these sustained flow rates, the overall quality or hardness of the water is of secondary importance. However, softer water will extend the life of a water-cooled panel.

During furnace operation, the transfer of heat through the cooling pipe 74 into the water generates steam bubbles at the inner surface of the pipe. The energy required to form these steam bubbles is extracted from the hot pipe, causing heat transfer, resulting in a cooling mechanism. The steam bubbles are transported away from the surface to prevent coagulation and the formation of larger bubbles, which would insulate the pipe from the water, reducing the cooling effect.

In that case, a deposit of calcium carbonate would be formed on the inner surface of the pipe, decreasing the heat transfer. This could cause cracking of the pipe parallel to the water flow direction.

In general, a minimum water flow velocity of 2.5 m/sec or 8 ft/sec should be sufficient to remove the small steam bubbles from the pipe surface.

The water pressure exiting the water-cooled panel should also be above 20 psi to avoid starving of individual water-cooled panels and to achieve uniform flow rates. For a given incoming water pressure, different water flow rates and pressure drops will cause panel problems if the water flow drops below the critical rate.

Three different materials can be used for the water-cooled panels. The most common material used for the panel construction is standard boiler grade type A steel. This material may suffer some fatigue phenomenon. The temperature within the furnace vessel will typically cycle between 300° F. and 320° F. This fluctuating temperature change and frequent expansion and contraction of the outer surface of the pipe will cause material failure and the pipe will break.

To combat the hot spots common in high powered melt electric arc furnaces, copper is more commonly used for the pipes. Copper pipes do not suffer fatigue like steel pipes and will, therefore, deliver a much longer life expectancy. Even at the higher price of a water-cooled panel, having copper pipes, many steel makers can justify the additional expense. Because copper pipe has a higher heat transfer coefficient than steel pipe, thicker slag layers can be formed on water-cooled panels having copper pipes. This results in reduced energy losses when compared to steel water-cooled panels.

If higher gas velocities and temperatures are present, pipes can be fabricated from another steel grade with chromium and molybdenum. Such materials deliver a higher strength at elevated temperatures than the regular boiler grade water-cooled panels.

The present invention is advantageous because it now allows formation of a scrap free area in the slag door portion and the "breast," while providing water-cooled panel that minimizes the tendency to attract an arc from the electrode. The unique, arcuate configured water-cooled panel of the present invention has the opposing side ends curving toward the inside surface of the melting vessel. It has a radius of curvature that progressively increases from the upper end to the lower end to position the lower end inwardly of the vessel. Thus, the tendency of an electric arc to be generated between the electrode and the water-cooled panel is reduced. The savings on electrode life and reduction in energy consumption can be significant over extended melts.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed and that the modifications and embodiments are intended to be included within the scope of the dependent claims.

That which is claimed is:

1. An electric arc furnace comprising:

a melting vessel having a top opening;

a removable roof positioned over the top opening that can be removed for permitting charging of scrap into the melting vessel;

at least one electrode extending through the roof into the melting vessel;

a slag door portion defining a slag discharge opening through which slag can be discharged from the melting furnace; and said melting vessel comprising an arcuate configured water-cooled panel, said arcuate configured water-cooled panel including opposing upper and lower ends and opposing side ends, and mounted above the slag door portion so that the lower end is angled inwardly away from an adjacent inside surface of the melting vessel, and the side ends curve toward the adjacent inside surface of the melting vessel to reduce a likelihood of arcing and to form a scrap free area adjacent the slag door portion.

2. The electric art furnace according to claim 1 wherein said arcuate configured water-cooled panel has a radius of curvature that progressively increases from the upper end to the lower end.

3. The electric arc furnace according to claim 1 wherein said arcuate configured water-cooled panel comprises a serpentine configured cooling pipe, and including at least one inlet and one outlet formed in the cooling pipe through which cooling fluid flows to and from the cooling pipe.

4. The electric arc furnace according to claim 3, wherein said serpentine configured cooling pipe further comprises a double inlet and double outlet forming two cooling circuits.

5. The electric arc furnace according to claim 3 wherein said serpentine configured cooling pipe further comprises a plurality of cooling pipe sections that extend horizontally from opposing side ends.

6. The electric arc furnace according to claim 5 wherein the distance between opposing side ends of the water-cooled panel is greater than the distance between opposing upper and lower ends.

7. The electric arc furnace according to claim 1 wherein said arcuate configured water-cooled panel further comprises an arcuate configured and vertically extending base plate supporting said water-cooled panel.

8. The electric arc furnace according to claim 1 wherein said melting furnace further includes a plurality of water-cooled panels defining the inside surface of the melting vessel.

9. The electric arc furnace according to claim 1 including an oxygen lance positioned adjacent to the slag door portion and means for moving the oxygen lance through the slag discharge opening defined in the slag door portion and into the scrap free area formed adjacent the slag door portion.

10. The electric arc furnace according to claim 1 including a slag door mounted on the melting vessel and covering the slag discharge opening formed in the slag door portion.

11. The electric arc furnace according to claim 1 including means for collecting slag poured from the slag door portion.

12. The electric arc furnace according to claim 11 wherein said means for collecting slag poured from the slag door portion comprises a slag pit.

13. The electric arc furnace according to claim 1 including a burner positioned in the slag door portion.

14. An electric arc furnace comprising:

a melting vessel, having a top opening and inside wall surface;

a removable roof positioned over the top opening that can be removed for permitting charging of scrap into the melting vessel;

at least one electrode extending through the roof into the melting vessel;

a slag door portion defining a slag discharge opening through which slag can be discharged from the melting furnace; and an arcuate configured water-cooled panel positioned above the slag door portion and spaced from the inside wall surface of the melting vessel for diverting scrap charged into the charging vessel away from the slag door portion, wherein said water-cooled panel is arcuate configured for reducing a likelihood of arcing between the electrode and the water-cooled panel.

15. An electric arc furnace according to claim 14, wherein said wherein said arcuate configured water-cooled panel includes opposing upper and lower ends and wherein the lower end is angled inwardly away from an adjacent inside surface of the melting vessel.

16. An electric arc furnace according to claim 15, wherein said arcuate configured water-cooled panel comprises opposing side ends formed on the panel, wherein said opposing side ends curve toward an adjacent inside surface of the melting vessel to reduce the likelihood of any arcing between the electrode and the panel.

17. An electric arc furnace according to claim 16, wherein said panel comprises an arcuate configured water-cooled panel.

18. The electric arc furnace according to claim 17 wherein said arcuate configured water-cooled panel comprises a serpentine configured cooling pipe, and including at least one inlet and outlet formed in the cooling pipe through which cooling fluid flows to and from the cooling pipe.

19. The electric arc furnace according to claim 18, wherein said serpentine configured cooling pipe further comprises a double inlet and double outlet forming two cooling circuits.

20. The electric arc furnace according to claim 18 wherein said serpentine configured cooling pipe further comprises a plurality of cooling pipe sections that extend horizontally from opposing side ends.

21. The electric arc furnace according to claim 20 wherein the distance between opposing side ends of the water-cooled panel is greater than the distance between opposing upper and lower ends.

22. The electric arc furnace according to claim 20 including a plurality of cooling pipe elbow joint sections that interconnect the horizontally extending cooling pipe sections.

23. The electric arc furnace according to claim 17 wherein said arcuate configured water-cooled panel further comprises an arcuate configured and vertically extending base plate defining an upper shell of the melting furnace and connected to said water-cooled panel for supporting said water-cooled panel.

24. An electric arc furnace according to claim 23, wherein said base plate includes means forming an opening for a burner.

25. An electric arc furnace according to claim 17 wherein said melting vessel further comprises an upper shell, and including a plurality of water-cooled panels defining an inside surface of the upper shell.

26. An electric arc furnace according to claim 14 including an oxygen lance positioned adjacent to the slag door portion and means for moving the oxygen lance through the slag discharge opening defined in the slag door portion and into the scrap free area adjacent the slag door portion.

27. An electric arc furnace according to claim 14 including a slag door mounted on the melting vessel and covering the slag discharge opening formed in the slag door portion.

28. An electric arc furnace according to claim 27 including means for collecting slag poured from the slag door portion.

29. An electric arc furnace according to claim 28 wherein said means for collecting slag poured from the slag door portion comprises a slag pit.

30. An electric arc furnace comprising:

a melting vessel, said melting vessel further comprising:

an upper shell having a top opening;

a removable roof positioned over the top opening that can be removed for permitting the charging of scrap into the vessel;

at least one electrode extending through the roof into the melting vessel;

a plurality of water-cooled panels defining the inside surface of the upper shell;

a slag door portion defining a slag discharge opening through which slag can be discharged from the melting furnace; and an arcuate configured water-cooled panel, including opposing upper and lower ends and opposing side ends, and positioned above the slag door portion so that the lower end is angled inwardly away from an adjacent inside surface, and the side ends curve toward an adjacent inside surface of the upper shell to reduce the likelihood of arcing between the opposing side ends and the electrode and form a scrap free area adjacent the slag door portion wherein said arcuate configured water-cooled panel has a radius of curvature that progressively increases from the upper end to the lower end to position the lower end inwardly of an adjacent inside surface of the melting vessel.

31. The electric arc furnace according to claim 30 wherein said arcuate configured water-cooled panel comprises a serpentine configured cooling pipe, and including at least one inlet and outlet formed in the cooling pipe through which cooling fluid flows to and from the cooling pipe.

32. The electric arc furnace according to claim 31 wherein said serpentine configured cooling pipe further comprises a double inlet and double outlet forming two cooling circuits.

33. The electric arc furnace according to claim 31 wherein said serpentine configured cooling pipe further comprises a plurality of cooling pipe sections that extend horizontally from opposing side ends.

34. The electric arc furnace according to claim 33 wherein the distance between opposing side ends of the water-cooled panel is greater than the distance between opposing upper and lower ends.

35. The electric arc furnace according to claim 33 including a plurality of cooling pipe elbow joint sections that interconnect the horizontally extending cooling pipe sections.

36. The electric arc furnace according to claim 30 wherein said arcuate configured water-cooled panel further comprises an arcuate configured and vertically extending base plate connected to said water-cooled panel and supporting said water-cooled panel.

37. The electric arc furnace according to claim 30 wherein said melting furnace includes a plurality of water-cooled panels positioned along the inside surface of the melting vessel.

38. The electric arc furnace according to claim 30 including an oxygen lance positioned adjacent to the slag door portion and means for moving the oxygen lance through the slag discharge opening into the scrap free area adjacent the slag door portion.

39. The electric arc furnace according to claim 30 including a scrap door mounted on the melting vessel for covering the slag discharge opening formed in the slag door portion.

40. The electric arc furnace according to claim 30 including means for collecting slag poured from the slag door portion.

41. The electric arc furnace according to claim 40 wherein said means for collecting slag poured from the slag door portion comprises a slag pit.

42. The electric arc furnace according to claim 30 including a burner positioned in the slag door portion.

43. A method of operating an electric arc furnace comprising the steps of:

charging scrap into a melting vessel by removing a roof of the melting vessel and placing scrap through an opening into the melting vessel;

closing the roof and generating an electric arc to the scrap through at least one electrode extending through the roof of the vessel; and extending an oxygen lance through a slag discharge opening and into the charging vessel into a slag free area formed by an arcuate configured water-cooled panel positioned above the slag door, wherein the arcuate configured water-cooled panel includes opposing upper and lower ends and opposing side ends, and is mounted in the melting vessel above the slag door portion so that the lower end is angled inwardly away from an adjacent inside surface of the melting vessel, and the side ends curve toward an adjacent inside surface of the upper shell to reduce any arcing between the opposing side ends and the electrode and form a scrap free area adjacent the slag door portion which remains free of scrap.

44. A method according to claim 43 further comprising the step of flowing water through at least one inlet formed in a serpentine configured cooling pipe contained in the water-cooled panel and discharging the water through at least one outlet formed in the serpentine configured cooling pipe.

45. A method according to claim 44 further comprising forcing water through two inlets into separate cooling circuits formed in the serpentine configured cooling pipe and discharging the water though respective two outlets of each circuit.

46. A method according to claim 43 further comprising the step of collecting slag poured from the slag discharge opening into a slag pit.

47. A method for operating an electric arc furnace comprising the steps of:

forming a melting vessel having a top opening and slag door portion defining a slag discharge opening through which slag can be discharged from the melting vessel; and positioning an arcuate configured scrap diverting panel above the slag door portion, wherein the arcuate configured scrap diverting panel includes opposing upper and lower ends and opposing side ends, and positioned above the slag door portion so that the lower end is angled inwardly away from an adjacent inside surface of the melting vessel, and the side ends curve toward an adjacent inside surface of the melting vessel.

48. A method according to claim 47 including the step of charging scrap into the melting vessel, wherein the scrap is diverted away from the slag door portion by the scrap diverting panel.

49. A method according to claim 47 including the step of generating an arc from at least one electrode extending from the roof of the electric arc furnace.

* * * * *

UNITED STATES PATENT AND TRADEMARK OFFICE

CERTIFICATE OF CORRECTION

PATENT NO. : 5,936,995
DATED : August 10, 1999
INVENTOR(S) : Sullivan et al.

It is certified that error appears in the above-identified patent and that said Letters Patent is hereby corrected as shown below:

Column 9,
Line 55, delete “17” and substitute -- 14 --

Column 10,
Line 9, delete “17” and substitute -- 14 --
Line 18, delete “17” and substitue -- 14 --

Signed and Sealed this

Fourth Day of February, 2003

JAMES E. ROGAN
*Director of the United States Patent and Trademark Office*